United States Patent [19]

Hass

[11] 4,147,139

[45] Apr. 3, 1979

[54] LIQUID-COOLED INTERNAL COMBUSTION ENGINE

[75] Inventor: Jürgen Hass, Weinstadt, Fed. Rep. of Germany

[73] Assignee: Daimler-Benz Aktiengesellschaft, Fed. Rep. of Germany

[21] Appl. No.: 785,227

[22] Filed: Apr. 6, 1977

[30] Foreign Application Priority Data

Apr. 10, 1976 [DE] Fed. Rep. of Germany ..... 2615728

[51] Int. Cl.[2] ..... F01P 11/02; F01P 11/04; F01P 7/16

[52] U.S. Cl. ..... 123/41.54; 123/41.1; 236/34.5

[58] Field of Search ..... 123/41.08, 41.09, 41.1, 123/41.27, 41.54; 236/34.5; 237/8 C, 12.3 B

[56] References Cited

U.S. PATENT DOCUMENTS

| | | | |
|---|---|---|---|
| 1,658,934 | 2/1928 | Muir | 123/41.54 |
| 2,201,314 | 5/1940 | Illsley | 123/41.27 X |
| 2,332,680 | 10/1943 | Wallace | 123/41.08 X |
| 2,336,068 | 12/1943 | Charles | 123/41.54 X |
| 2,790,605 | 4/1957 | Peterson et al. | 237/12.3 B |
| 3,132,634 | 5/1964 | Butler | 123/41.54 |
| 3,221,720 | 12/1965 | Dangauthier | 123/41.09 |
| 3,726,262 | 4/1973 | Moon | 123/41.1 |
| 3,851,629 | 12/1974 | Mayr et al. | 237/12.3 B |
| 3,921,600 | 11/1975 | Henning et al. | 123/41.08 X |

FOREIGN PATENT DOCUMENTS 1288360 1/1969 Fed. Rep. of Germany ..... 123/41.54

*Primary Examiner*—Charles J. Myhre
*Assistant Examiner*—Jeffrey L. Yates
*Attorney, Agent, or Firm*—Craig & Antonelli

[57] ABSTRACT

A liquid-cooled internal combustion engine with a control of the cooling medium temperature of its cooling medium circulation by a thermostatically operating mixing valve which includes a mixing chamber in open communication with the suction connection of a circulating pump interconnected in the cooling medium circulation, a return chamber connected by way of a radiator return line with the cooling medium outlet of a radiator and adapted to be closed off with respect to the mixing chamber by way of a return control valve, and a by-pass channel connected with the cooling medium outlet of the internal combustion engine and adapted to be closed off with respect to the mixing chamber by a by-pass control valve; the cooling medium outlet of the mixing valve is connected by way of a radiator inlet line with the cooling medium inlet of the radiator while the return chamber is connected by way of a vent connection with an auxiliary chamber fed with cooling medium by the circulating pump for the formation of a liquid seal; the auxiliary chamber in its turn includes a vent connection to a geodetic high point of the cooling medium circulation serving for the air separation.

8 Claims, 2 Drawing Figures

LIQUID-COOLED INTERNAL COMBUSTION ENGINE

Figure 1:
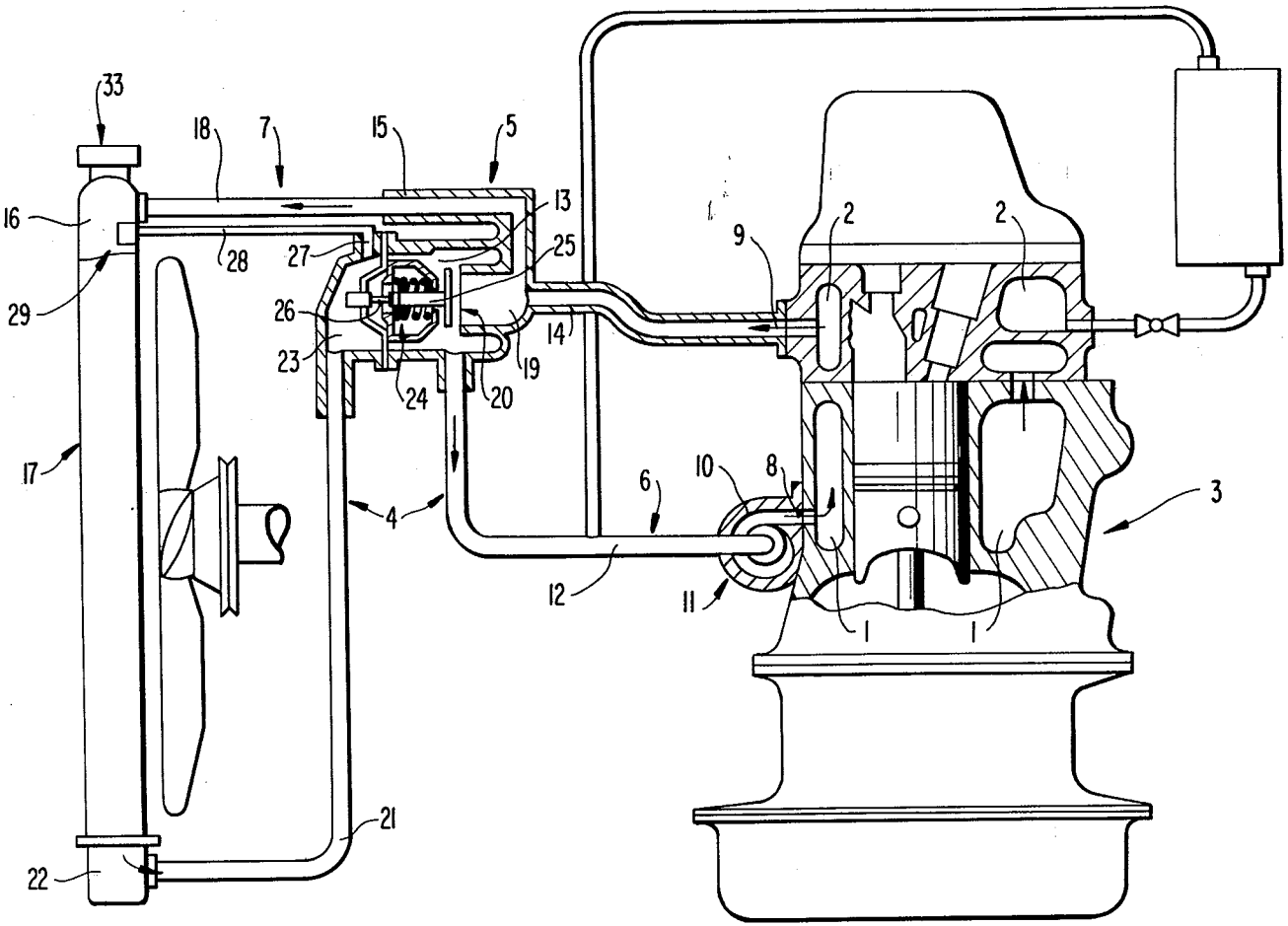

The present invention relates to a liquid-cooled internal combustion engine with a control of the cooling medium temperature of its cooling medium circulatory system by a thermostatically operating mixing valve which includes a mixing chamber in open communication with the suction connection of a circulating pump interconnected in the cooling medium circulation and a return chamber connected with the cooling medium outlet of a radiator by way of a radiator return line and adapted to be closed off with respect to the mixing chamber by a return control valve as well as a by-pass channel connected with the cooling medium outlet of the internal combustion engine and adapted to be closed off with respect to the mixing chamber by way of a by-pass control valve, and whose cooling medium outlet is connected by way of a radiator inlet line with the cooling medium inlet of the radiator.

Internal combustion engines of this type are known in the prior art (German Auslegeschrift No. 1,295,255). With these prior art internal combustion engines, the two control valves are actuated by an expansion element installed into the mixing chamber, which responds to the temperature of the cooling medium that will adjust itself in the mixing chamber. With a cold engine, the return control valve is closed whereas in contradistinction thereto the by-pass control valve is opened. During the filling of the cooling system, there exists therefore the danger that a considerable air pocket forms in the line system between the radiator and the return control valve, which may lead to the breaking away or separation of the cooling medium stream.

The present invention is concerned with the task to avoid the formation of an air pocket at the return control valve.

The underlying problems are solved in an advantageous manner according to the present invention in that the return chamber is connected by way of a vent connection with an auxiliary chamber fed with cooling medium by the circulating pump for the formation of a liquid seal, and in that the auxiliary chamber, in its turn, includes a vent connection to a geodetic high point of the cooling medium circulation serving for the air separation.

In the internal combustion engine according to the present invention, an effective fill-in venting for the line system upstream of the return control valve is produced, in which the drawing-in of air by the circulating pump is avoided during the operation of the internal combustion engine by means of the liquid seal of the auxiliary chamber, when the return control valve is opened. The circulating pump could be connected with the auxiliary chamber, for example, by a separate feed line in order to fill continuously the liquid seal of the auxiliary chamber.

The arrangement of the auxiliary chamber which may be vented, for example, into a conventional expansion tank for the volume equalization and the air separation of the cooling medium, may be of any desired, known construction.

In one advantageous embodiment of the internal combustion engine according to the present invention, in which the upper water tank or water box of the radiator operates as air-separating chamber, provision is made that a trough is arranged in the upper water box which is fed with the liquid seal by way of the radiator inlet line and which is connected with the return chamber.

In this arrangement, the trough is open in the upward direction toward the air space of the water box so that a separate vent connection can be economized. This is also true for a separate feed line for the formation of the liquid seal, whose function is assumed in this arrangement by the radiator inlet line, for with an open return control valve, the radiator inlet line conducts necessarily at least a part of the cooling medium quantity forced per unit time through the cooling spaces by the circulating pump.

In order to avoid with this construction a separate connecting line to the trough, which taps the radiator inlet line, the arrangement may be made in such a manner that the trough is located underneath the chamber connection for the radiator inlet line in the turbulent region of the cooling medium stream.

Accordingly, it is an object of the present invention to provide a liquid-cooled internal combustion engine which avoids by simple means the aforementioned shortcomings and drawbacks encountered in the prior art.

Another object of the present invention resides in a liquid-cooled internal combustion engine which effectively prevents the formation of an air pocket in the line system between the radiator and the return control valve.

A further object of the present invention resides in a liquid-cooled internal combustion engine in which any air that might collect at the return control valve is effectively vented by extremely simple means.

Still another object of the present invention resides in a liquid-cooled internal combustion engine in which special lines can be economized.

Figure 2:
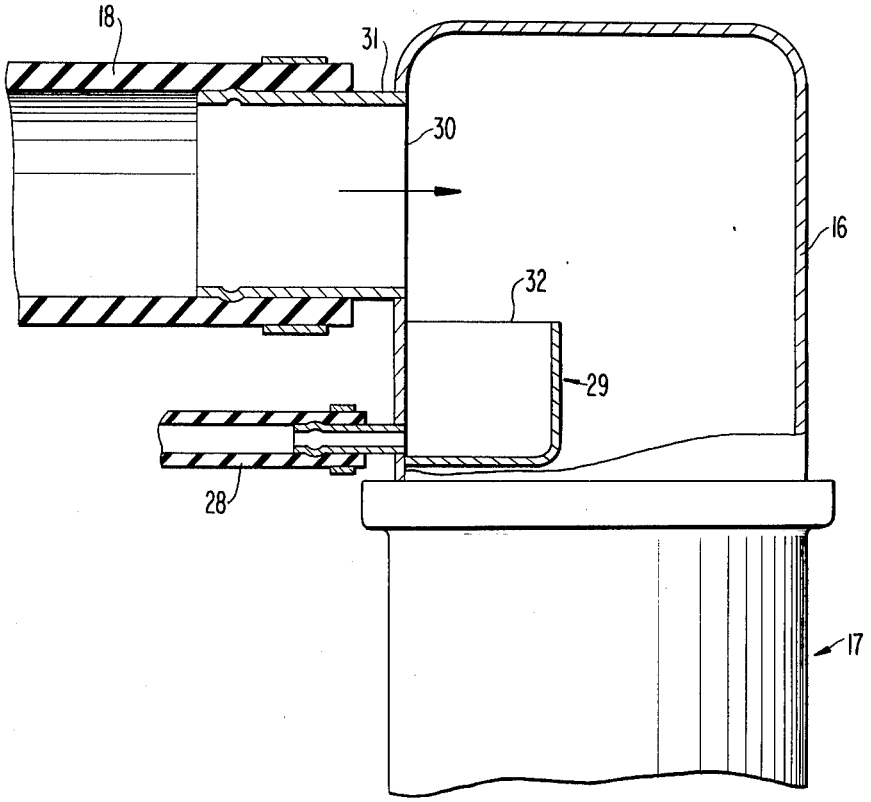

These and other objects, features and advantages of the present invention will become more apparent from the following description when taken in connection with the accompanying drawing which shows, for purposes of illustration only, one embodiment in accordance with the present invention, and wherein:

FIG. 1 is a schematic view of the cooling system of an internal combustion engine according to the present invention, illustrating the details essential for the present invention; and FIG. 2 is a partial cross-sectional view on an enlarged scale through the upper water box of the radiator of the cooling system illustrated in FIG. 1.

Referring now to the drawings wherein like reference numerals are used throughout the two views to designate like parts, the cooling spaces 1 and 2 of the internal combustion engine generally designated by reference numeral 3 which are traversed successively by the cooling medium are interconnected in the cooling medium circulatory system generally designated by reference numeral 4 which is subdivided by a thermostatically operating mixing valve generally designated by reference numeral 5 into a by-pass circulation generally designated by reference numeral 6 and a radiator circulation generally designated by reference numeral 7. The cooling medium inlet and outlet of the internal combustion engine 3 are designated by reference numerals 8 and 9.

A circulating pump 11 which is connected with its pressure connection 10 to the cooling medium inlet 8 of the internal combustion engine 3 and which is driven by the internal combustion engine 3 is in open communication by way of a suction line 12 with a mixing chamber 13 of the mixing valve 5. The mixing valve 5 is provided with two communicating valve connections 14 and 15 for the cooling medium outlet 9 and for a radiator inlet line 18 leading to the upper water box 16 of a radiator 17. A by-pass channel 19 of the mixing valve 5 which is connected with the cooling medium outlet 9 by way of the valve connection 14 is connected with the mixing chamber 13 by way of a by-pass control valve 20. A return chamber 23 of the mixing valve 5 which is connected by way of a radiator return line 21 with the lower water box 22 of the radiator 17 is connected with the mixing chamber 13 by way of a return control valve 24. The control valves 20 and 24 are actuated in a conventional manner by a cylinder 25 of an expansion element which is arranged in the mixing chamber 13 and is filled with a temperature-sensitive expansion material, whose piston rod 26 is locally fixed in the mixing valve 5 by conventional means.

A venting channel indicated by reference numeral 27 is provided in the housing of the mixing valve 5, which terminates at one end in the return chamber 23 and at the other end in a vent line 28. The vent line 28 extends to a trough 29 arranged in the upper water box 16, which is arranged underneath the opening 30 (FIG. 2) terminating in the water box 16 of the chamber connection 31 for the radiator inlet line 18 and which is open in the upward direction. The upper opening 32 of the trough 29 is located in the turbulent region of the cooling medium stream passing through the opening 30. In this manner, the trough 29 receives continuously a liquid seal supplied by the circulating pump 11 by way of the radiator inlet line 18 in order to avoid the sucking-in of air out of the water box 16 by the circulating pump 11 by way of parts 28-23-12, when the return control valve 24 is opened.

During the refilling of the cooling system, the trough 29 is emptied so that the radiator return line 21 and the return chamber 23 are vented into the atmosphere at the upper water box 16 by way of the vent line 28 and the opened fill-in connection 33.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A liquid-cooled internal combustion engine having a cooling medium outlet and a control of the cooling medium temperature of its cooling medium circulation, comprising a thermostatically operating mixing valve means which includes a mixing chamber means, a circulating pump having a suction connection, the suction connection of the circulating pump being interconnected into the cooling medium circulation in substantially open communication with the mixing chamber means, radiator means having an inlet, an outlet, and inlet and return lines for the cooling medium, a return chamber means operatively connected by way of the radiator return line with the radiator outlet of the radiator means, a return valve means for closing off the return chamber means with respect to the mixing chamber means, and a by-pass channel means operatively connected with the cooling medium outlet of the internal combustion engine and by-pass control valve means for closing off the by-pass channel means with respect to the mixing chamber means, said mixing valve means having a cooling medium outlet connected by way of the radiator inlet line with the cooling medium inlet of the radiator means, characterized in that a first vent connection means and an auxiliary chamber means are provided, said first vent connection means interconnecting the return chamber with said auxiliary chamber means, said auxiliary chamber means being associated with the circulation pump in a manner enabling said auxiliary chamber means to be fed by the circulating pump with cooling medium so as to form a liquid seal means in said auxiliary chamber means for preventing air from being drawn into the cooling system by the circulating pump upon opening of the return control valve means due to the maintenance of said liquid seal being independent of the position of said return control valve means and in that the auxiliary chamber means includes a second vent connection means which is open to a geodetic high place in the cooling medium circulation and which serves for the air separation.

2. An internal combustion engine according to claim 1, characterized in that the auxiliary chamber means includes a trough means.

3. An internal combustion engine according to claim 2, characterized in that the first vent connection means includes a line connecting the return chamber means with the auxiliary chamber means and in that the second vent connection means includes an opening in the trough means.

4. An internal combustion engine according to claim 1, in which the radiator has an upper water box means which operates as an air separating chamber, characterized in that the auxiliary chamber means comprises a trough means connected with the return chamber means and wherein the liquid seal is formed in the upper water box means.

5. An internal combustion engine according to claim 4, characterized in that the radiator has a chamber connection for the radiator inlet line underneath which the trough means is located within the turbulent region of the cooling medium stream.

6. An internal combustion engine according to claim 4, characterized in that the first vent connection means includes a line connecting the return chamber means with the auxiliary chamber means and in that the second vent connection means includes an opening in the trough means.

7. An internal combustion engine according to claim 2, characterized in that the radiator has a chamber connection for the radiator inlet line underneath which the trough means is located within the turbulent region of the cooling medium stream.

8. An internal combustion engine according to claim 7, in which the radiator has an upper water box means which operates as an air separating chamber, characterized in that the auxiliary chamber means comprises a trough means connected with the return chamber means and wherein the liquid seal is formed in the upper water box means.

* * * * *